US005180866A

United States Patent [19]

Sanderson et al.

[11] Patent Number: 5,180,866

[45] Date of Patent: Jan. 19, 1993

[54] PROCESS FOR PREPARING SYNTHETIC LUBRICANT BASE STOCKS HAVING IMPROVED VISCOSITY FROM VINYLCYCLOHEXENE AND LONG-CHAIN OLEFINS

[75] Inventors: John R. Sanderson, Leander; Wheeler C. Crawford, Houston; David R. McCoy, Austin, all of Tex.

[73] Assignee: Texaco Chemical Company, White Plains, N.Y.

[21] Appl. No.: 676,492

[22] Filed: Mar. 28, 1991

[51] Int. Cl.[5] ..... C10M 107/22; C07C 2/02

[52] U.S. Cl. ..... 585/12; 585/533

[58] Field of Search ..... 585/532, 727, 12

[56] References Cited

U.S. PATENT DOCUMENTS

| | | | |
|---|---|---|---|
| 2,327,705 | 8/1943 | Frolich et al. | 252/59 |
| 2,732,408 | 1/1956 | Foote | 260/624 |
| 3,173,965 | 3/1965 | Pappas et al. | 260/667 |
| 3,716,596 | 2/1973 | Bowes | 260/671 C |
| 3,849,507 | 11/1974 | Zurch | 260/671 C |
| 3,876,720 | 4/1975 | Heilman et al. | 260/677 R |
| 3,959,399 | 5/1976 | Bridwell et al. | 260/671 C |
| 4,113,657 | 9/1978 | Herbstman et al. | 255/442 |
| 4,214,111 | 7/1980 | Kitamura et al. | 585/255 |
| 4,420,646 | 12/1983 | Darden et al. | 585/10 |
| 4,480,142 | 10/1984 | Cobb | 585/465 |
| 4,556,750 | 12/1985 | Cobb | 585/446 |
| 4,604,491 | 8/1986 | Dresler | 585/26 |
| 4,620,048 | 10/1986 | Ver Strate et al. | 585/10 |
| 4,788,362 | 11/1988 | Kaneko | 585/10 |
| 4,827,064 | 5/1989 | Wu | 585/10 |
| 4,892,680 | 1/1990 | Ishida | 252/565 |
| 4,962,262 | 10/1990 | Winter et al. | 585/512 |
| 4,967,029 | 10/1990 | Wu | 585/12 |
| 4,968,853 | 11/1990 | Seharf | 585/10 |

FOREIGN PATENT DOCUMENTS

| | | |
|---|---|---|
| 0353813 | 2/1990 | European Pat. Off. . |
| 1489646 | 10/1977 | United Kingdom . |

OTHER PUBLICATIONS

Olah, G. A., *Friedel-Crafts and Related Reactions*, vol. 1, N.Y. Interscience Publishers (1963) pp. 191-197.

Chaudhuri and Sherma, "Some Novel Aspects of the Dimerization of 8-Methylstyrene with Acidic Ion-Exchange Resins, Clays, and Other Acidic Materials as Catalysts," Ind. Eng. Res. vol. 28, pp. 1757-1763 (1989).

R. T. Sanderson, "Viscosity-Temperature Characteristics of Hydrocarbons," Industrial and Engineering Chemistry, vol. 41, No. 2 (Feb. 1949).

Dixon and Clark, "Physical Properties of High Molecular Weight Alkylbenzene and Alkylclohexanes," Journal of Chemical Engineering Data, vol. 4, No. 1 (Jan. 1959).

D. N. Tsvetkov and M. A. Chagina "Synthesis and Properties of Alkylnaphthalene Vacuum Pump Oil" All Union Scientific Research Institute of Petroleum Processing, Neptepereabotha i Nepteklimica (Moscow) 1983 (1) pp. 22-23.

Bolen, "Synthetic Lubricated Base Stocks", Process Economics Program Report No. 125A by SRI International, Apr. 1989 and Supplement A, Sep. 1989.

"Synthetic Lubricants from Internal Olefins," Process Evaluation/Research Planning Report by Chem Systems, 84-Q-1, pp. 17-45.

*Primary Examiner*—Asok Pal
*Assistant Examiner*—P. Achutamurthy
*Attorney, Agent, or Firm*—Jack H. Park; Kenneth R. Priem; Russell R. Stolle

[57] ABSTRACT

A process for preparing synthetic lubricant base stocks having improved properties is disclosed. The process comprises co-reacting vinylcyclohexene and long-chain linear olefin in the presence of a Friedel-Crafts type catalyst, preferably anhydrous aluminum chloride.

17 Claims, No Drawings

PROCESS FOR PREPARING SYNTHETIC LUBRICANT BASE STOCKS HAVING IMPROVED VISCOSITY FROM VINYLCYCLOHEXENE AND LONG-CHAIN OLEFINS

CROSS-REFERENCE TO RELATED APPLICATION

This application is related to co-pending U.S. patent application Ser. No. 07/580,439, filed Sep. 10, 1990.

BACKGROUND OF THE INVENTION

The invention relates to the preparation of synthetic lubricant base stocks, and more particularly to synthetic lubricant base stocks having improved properties, made by co-reacting vinylcyclohexene and long-chain olefins.

Synthetic lubricants are prepared from man-made base stocks having uniform molecular structures and, therefore, well-defined properties that can be tailored to specific applications. Mineral oil base stocks, on the other hand, are prepared from crude oil and consist of complex mixtures of naturally occurring hydrocarbons. The higher degree of uniformity found in synthetic lubricants generally results in superior performance properties. For example, synthetic lubricants are characterized by excellent thermal stability. As automobile engines are reduced in size to save weight and fuel, they run at higher temperatures, therefore requiring a more thermally stable oil. Because lubricants made from synthetic base stocks have such properties as excellent oxidative/thermal stability, very low volatility, and good viscosity indices over a wide range of temperatures, they offer better lubrication and permit longer drain intervals, with less oil vaporization loss between oil changes.

Synthetic base stocks may be prepared by oligomerizing internal and alpha-olefin monomers to form a mixture of dimers, trimers, tetramers, and pentamers, with minimal amounts of higher oligomers. The unsaturated oligomer products are then hydrogenated to improve their oxidative stability. The resulting synthetic base stocks have uniform isoparaffinic hydrocarbon structures similar to high quality paraffinic mineral base stocks, but have the superior properties mentioned due to their higher degree of uniformity.

Synthetic base stocks are produced in a broad range of viscosity grades. It is common practice to classify the base stocks by their viscosities, measured in centistokes (cSt) at 100° C. Those base stocks with viscosities less than or equal to about 4 cSt are commonly referred to as "low viscosity" base stocks, whereas base stocks having a viscosity in the range of around 40 to 100 cSt are commonly referred to as "high viscosity" base stocks. Base stocks having a viscosity of about 4 to about 8 cSt are referred to as "medium viscosity" base stocks. The low viscosity base stocks generally are recommended for low temperature applications. Higher temperature applications, such as motor oils, automatic transmission fluids, turbine lubricants, and other industrial lubricants, generally require higher viscosities, such as those provided by medium viscosity base stocks (i.e., 4 to 8 cSt grades). High viscosity base stocks are used in gear oils and as blending stocks.

The viscosity of the base stocks is determined by the length of the oligomer molecules formed during the oligomerization reaction. The degree of oligomerization is affected by the catalyst and reaction conditions employed during the oligomerization reaction. The length of the carbon chain of the monomer starting material also has a direct influence on the properties of the oligomer products. Fluids prepared from short-chain monomers tend to have low pour points and moderately low viscosity indices, whereas fluids prepared from long-chain monomers tend to have moderately low pour points and higher viscosity indices. Oligomers prepared from long-chain monomers generally are more suitable than those prepared from shorter-chain monomers for use as medium viscosity synthetic lubricant base stocks.

With respect to the present invention, Applicants have found, surprisingly, that synthetic lubricant base stocks with a higher viscosity may be obtained where vinylcyclohexene and long-chain olefins are co-reacted in the presence of a Friedel-Crafts type catalyst. Additionally, incorporating the vinylcyclohexene lowers the cost of producing the base stocks by replacing a portion of the more expensive long-chain olefin feed with vinylcyclohexene.

SUMMARY OF THE INVENTION

The invention relates to a process for the preparation of synthetic lubricant base stocks, comprising co-reacting vinylcyclohexene and a linear olefin having from 10 to 24 carbon atoms in the presence of a Friedel-Crafts catalyst. The invention further relates to a process for the preparation of synthetic lubricant base stocks, comprising the steps of (1) co-reacting vinylcyclohexene and a linear olefin having from 14 to 18 carbon atoms in the presence of an aluminum halide catalyst and (2) removing from the mixture resulting from the first step any non-oligomerized olefin and unreacted vinylcyclohexene.

DESCRIPTION OF THE PREFERRED EMBODIMENTS

Applicants have discovered that synthetic lubricant base stocks having improved properties may be prepared in good yield by co-reacting long-chain olefins and vinylcyclohexene using a process comprising co-reacting vinylcyclohexene and a linear olefin having from 10 to 24 carbon atoms in the presence of a Friedel-Crafts catalyst. The resulting synthetic lubricant base stocks comprise a mixture of (1) oligomers of the $C_{10}$ to $C_{24}$ linear olefin; and (2) compounds selected from the group consisting of the following formulas:

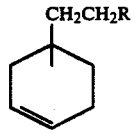

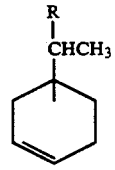

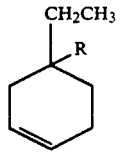

-continued

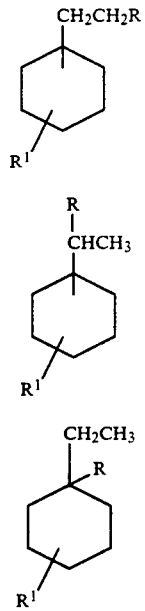

where R is an alkyl or alkenyl group having at least 10 carbon atoms and $R^1$ is an alkyl group having at least 10 carbon atoms. Preferably, the resulting mixture is then hydrogenated to reduce any unsaturation present in the oligomers, alkenyl groups and cyclohexene rings. Hydrogenation results in a synthetic lubricant base stock comprising a mixture of (1) reduced oligomers prepared from a linear olefin having from 10 to 24 carbon atoms; and (2) a compound selected from the group consisting of the following formulas:

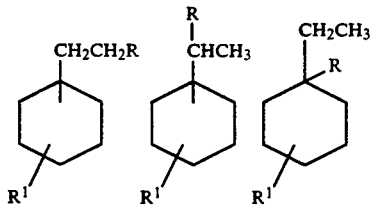

where R is an alkyl group having at least 10 carbon atoms and $R^1$ is H or an alkyl group having at least 10 carbon atoms.

Olefin monomer feed stocks useful in the present invention include compounds comprising (1) alpha-olefins having the formula $R''CH{=}CH_2$, where R'' is an alkyl radical of 8 to 22 carbon atoms, and (2) internal olefins having the formula $RCH{=}CHR'$, where R and R' are the same or different alkyl radicals of 1 to 21 carbon atoms, provided that the total number of carbon atoms in any one olefin shall be within the range of 10 to 24, inclusive. A preferred range for the total number of carbon atoms in any one olefin molecule is 14 to 18, inclusive. An especially preferred range is 14 to 16, inclusive. Mixtures of internal and alpha-olefins may be used, as well as mixtures of olefins having different numbers of carbon atoms, provided that the total number of carbon atoms in any one olefin shall be within the range of 10 to 24, inclusive. The alpha and internal-olefins useful in the present invention may be obtained by processes well-known to those skilled in the art and are commercially available.

Vinylcyclohexene feedstocks may be obtained as a dimer of butadiene by processes well-known to those skilled in the art and are commercially available. As used herein, "vinylcyclohexene" is meant to include 4-vinyl-1-cyclohexene and its isomers, including compounds having the following formulas:

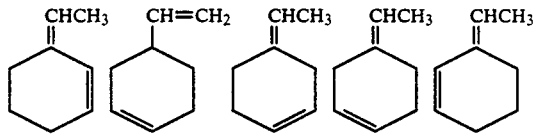

Preferably, the vinylcyclohexene comprises from about 1 to about 40 wt. % of the starting materials charged to the reactor (i.e. in a weight ratio of vinylcyclohexene to linear olefin of about 1:99 to about 2:3). It is especially preferred that the vinylcyclohexene comprise from about 5 to about 20 wt. % of the starting materials (i.e. in a weight ratio of vinylcyclohexene to linear olefin of about 1:20 to about 1:5).

The oligomerization of the linear olefin feedstock may be represented by the following general equation:

$$nC_mH_{2m} \xrightarrow{\text{catalyst}} C_{mn}H_{2mn}$$

where n represents moles of monomer and m represents the number of carbon atoms in the monomer. Thus, the oligomerization of 1-decene may be represented as follows:

$$nC_{10}H_{20} \xrightarrow{\text{catalyst}} C_{10n}H_{20n}$$

The oligomerization reactions occur sequentially. Initially, olefin monomer reacts with olefin monomer to form dimers. Some of the dimers that are formed then react with additional olefin monomer to form trimers, and so on. This results in an oligomer product distribution that varies with reaction time. As the reaction time increases, the olefin monomer conversion increases, and the selectivities for the heavier oligomers increase.

The reaction of vinylcyclohexene and long-chain olefin, such as 1-decene, may result in several products. For example, the double bond of the vinyl group may react with decene, to form a higher molecular weight alkenyl group (via ionic reaction) or alkyl group (via free radical), as shown below:

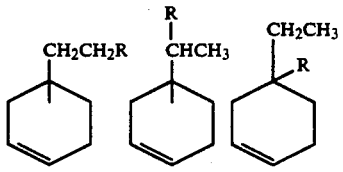

where R is an alkyl or alkenyl group having at least 10 carbon atoms. Depending on the mole ratio of linear olefin to vinylcyclohexene and reaction conditions, R may exceed 10 carbon atoms (in this case in multiples of 10) because after one molecule of decene reacts with the vinyl group to form an alkenyl group, another molecule of decene may react with the alkenyl group. Additionally, the double bond of the cyclohexene ring may react with decene to form an alkyl group. One or both double bonds also may react with other vinylcyclohexene.

The catalysts used in the present invention are Friedel-Crafts type catalysts, e.g., metallic halides. Aluminum halide catalysts are preferred. Examples of aluminum halide catalysts that may be used in the present invention include aluminum chloride, aluminum bromide, aluminum iodide, and aluminum fluoride. Anhydrous aluminum chloride is especially preferred. Other suitable catalysts include such Lewis Acids as those described by G. A. Olah in *Friedel-Crafts and Related Reactions,* vol. 1, New York Interscience Publishers (1963), incorporated herein by reference.

The co-reactions of the present invention may be carried out in either a stirred slurry reactor or in a fixed bed continuous flow reactor. The catalyst concentration should be sufficient to provide the desired catalytic effect. The temperatures at which the reactions may be performed are between about 50° C. and 300° C., with the preferred range being about 150° C. to 180° C. The reaction may be run at pressures of from 0 to 1000 psig.

Following the reaction, it is preferred that the resulting mixture be hydrogenated to reduce any unsaturation present in the oligomers, alkenyl groups, and cyclohexene rings, to improve their thermal stability and to guard against oxidative degradation during the mixture's use as a lubricant. The hydrogenation reaction for 1-decene oligomers may be represented as follows:

$$C_{10n}H_{20n} + H_2 \xrightarrow{\text{catalyst}} C_{10n}H_{(20n+2)}$$

where n represents moles of monomer used to form the oligomer. Hydrogenation processes known to those skilled in the art may be used. A number of metal catalysts are suitable for promoting the hydrogenation reaction, including nickel, platinum, palladium, copper, and Raney nickel. These metals may be supported on a variety of porous materials such as kieselguhr, alumina, or charcoal. A particularly preferred catalyst for this hydrogenation is a nickel-copper-chromia catalyst described in U.S. Pat. No. 3,152,998, incorporated by reference herein. Other U.S. patents disclosing known hydrogenation procedures include U.S. Pat. Nos. 4,045,508; 4,013,736; 3,997,622; and 3,997,621. Those skilled in the art will recognize that the catalyst and hydrogenation conditions employed may be manipulated to result in varying degrees of hydrogenation, such as, for example, resulting in a base stock containing reduced olefin oligomers and alkylated vinylcyclohexenes having some remaining unsaturation.

Unreacted monomer and vinylcyclohexene may be removed either prior to or after the hydrogenation step. Optionally, unreacted monomer and vinylcyclohexene may be stripped from the mixture prior to hydrogenation and recycled to the catalyst bed for co-reaction. The removal or recycle of unreacted monomer and vinylcyclohexene or, if after hydrogenation, the removal of non-oligomerized alkane and unreacted ethylcyclohexane, should be conducted under mild conditions using vacuum distillation procedures known to those skilled in the art. Distillation at temperatures exceeding 250° C. may cause the oligomers to break down in some fashion and come off as volatiles. Preferably, therefore, the reboiler or pot temperature should be kept at or under about 180° C. Procedures known by those skilled in the art to be alternatives to vacuum distillation also may be employed to separate unreacted components from the mixture.

While it is known to include a distillation step after the hydrogenation procedure to obtain products of various 100° C. viscosities, it is preferred in the method of the present invention that no further distillation (beyond removal of any unreacted monomer/linear alkane and vinylcyclohexene/ethylcyclohexane) be conducted. Thus, the method of this invention does not require the costly, customary distillation step, yet, surprisingly, produces a synthetic lubricant component that has excellent properties and that performs in a superior fashion. However, in some contexts, one skilled in the art may find subsequent distillation useful in the practice of this invention.

The invention will be further illustrated by the following examples, which are given by way of illustration and not as limitations on the scope of this invention. The entire text of every patent, patent application or other reference mentioned above is incorporated herein by reference.

EXAMPLES

1-Tetradecene, vinylcyclohexene, and catalyst were charged to a flask equipped with an overhead stirrer, a water cooled condenser, a heating mantle, and a nitrogen purge. The mixture was heated to the desired temperature for the desired time with vigorous stirring. At the end of the reaction, the mixture was cooled to ambient temperature, and 200 ml of cyclohexane was added. The entire mixture was then poured into 100 ml of ice-cold water. The water and organic layers were separated and the organic layer was washed twice more with 100 ml water. The organic layer was then dried over anhydrous sodium sulfate, filtered, and the cyclohexane and low-boilers removed on a rotary evaporator. The viscosities were determined on the bottoms product. Results are summarized in the table that follows.

| Ex. No. | Vinylcyclohexene (Wt. %) | Catalyst | Wt. % of Catalyst | Time (hr) | Temp. (°C.) | Bottoms (Wt. %) | Viscosity (cSt @ 210° F.) | Viscosity Index |
|---|---|---|---|---|---|---|---|---|
| 1 | 0 | $AlCl_3$ | 5.0 | 2.0 | 80 | 75 | 21.1 | 166 |
| 2 | 10 | $AlCl_3$ | 5.0 | 2.0 | 80 | 86 | 33.8 | 156 |
| 3 | 0 | $AlCl_3$ | 2.5 | 2.0 | 80 | 91 | 16.1 | 166 |
| 4 | 10 | $AlCl_3$ | 2.5 | 2.0 | 80 | 85 | 30.2 | 177 |
| 5 | 0 | $SnCl_4$ | 2.2 | 4.0 | 80 | <10 | nd[2] | nd |
| 6 | 10 | $SnCl_4$ | 2.0 | 4.0 | 80 | <10 | nd | nd |
| 7 | 0 | $ZnCl_2$ | 5.0 | 4.0 | 80 | <1 | nd | nd |
| 8 | 10 | $ZnCl_2$ | 5.0 | 4.0 | 80 | <1 | nd | nd |
| 9 | 0 | $AlCl_3$ | 5.0 | 2.0 | 80 | 98 | 15.4 | 165 |
| 10 | 50 | $AlCl_3$ | 5.0 | 2.0 | 80 | 73 | 21.2 | 165 |

-continued

| Ex. No. | Vinylcyclohexene (Wt. %) | Catalyst | Wt. % of Catalyst | Time (hr) | Temp. (°C.) | Bottoms (Wt. %) | Viscosity (cSt @ 210° F.) | Viscosity Index |
|---|---|---|---|---|---|---|---|---|
| 11 | 100 | $AlCl_3$ | 5.0 | 2.0 | 80 | sp[1] | nd | nd |

[1]sp = solid product;
[2]nd = not determined.

We claim:

1. A process for preparing synthetic lubricant base stocks, comprising co-reacting vinylcyclohexene and linear olefins having from 10 to 24 carbon atoms in the presence of a Friedel-Crafts catalyst.

2. The process of claim 1, wherein the vinylcyclohexene and linear olefins are co-reacted in a weight ratio of vinylcyclohexene to linear olefins of about 1:99 to about 2:3.

3. The process of claim 1, wherein the vinylcyclohexene and linear olefins are co-reacted in a weight ratio of vinylcyclohexene to linear olefins of about 1:20 to about 1:5.

4. The process of claim 1, wherein the linear olefins have from 14 to 18 carbon atoms.

5. The process of claim 1, further comprising the second step of removing from the mixture resulting from the first step any non-oligomerized olefins and unreacted vinylcyclohexene.

6. The process of claim 1, wherein the Friedel-Crafts catalyst comprises an aluminum halide.

7. The process of claim 1, wherein the Friedel-Crafts catalyst comprises anhydrous aluminum chloride.

8. The process of claim 1, further comprising the second step of hydrogenating the co-reaction products of the first step under such conditions as to reduce any unsaturation in the co-reaction products.

9. The process of claim 8, further comprising the third step of removing from the mixture resulting from the second step any non-oligomerized alkanes and unreacted ethylcyclohexane.

10. The process of claim 1, further comprising the second step of hydrogenating the products of the first step under such conditions as to obtain a mixture comprising (1) reduced olefin oligomers and (2) alkylated vinylcyclohexenes.

11. The process of claim 10, further comprising the third step of removing from the mixture resulting from the second step any non-oligomerized alkanes and unreacted vinylcyclohexene.

12. A process for preparing synthetic lubricant base stocks, comprising the steps of (1) co-reacting vinylcyclohexene and linear olefins having from 14 to 18 carbon atoms in the presence of an aluminum halide catalyst and (2) removing from the mixture resulting from the first step any non-oligomerized olefins and unreacted vinylcyclohexene.

13. The process of claim 12, wherein the vinylcyclohexene and linear olefins are co-reacted in a weight ratio of vinylcyclohexene to linear olefins of about 1:99 to about 2:3.

14. The process of claim 12, wherein the vinylcyclohexene and linear olefins are co-reacted in a weight ratio of vinylcyclohexene to linear olefins of about 1:20 to about 1:5.

15. The process of claim 12, wherein the aluminum halide catalyst comprises anhydrous aluminum chloride.

16. The process of claim 12, further comprising the third step of hydrogenating the mixture resulting from the second step under such conditions as to reduce any unsaturation in the remaining co-reaction products.

17. The process of claim 12, further comprising the third step of hydrogenating the remaining products of the second step under such conditions as to obtain a mixture comprising (1) reduced olefin oligomers and (2) alkylated vinylcyclohexenes.

* * * * *